US005894215A

United States Patent [19]

Yazdy et al.

[11] Patent Number: 5,894,215

[45] Date of Patent: Apr. 13, 1999

[54] SHUNT VOLTAGE REGULATOR UTILIZING A FLOATING REFERENCE VOLTAGE

[75] Inventors: Mostafa R. Yazdy; Harry J. McIntyre, both of Los Angeles, Calif.

[73] Assignee: Xerox Corporation, Stamford, Conn.

[21] Appl. No.: 08/960,783

[22] Filed: Oct. 30, 1997

[51] Int. Cl.[6] ..... G05F 1/44

[52] U.S. Cl. ..... 323/282

[58] Field of Search ..... 323/273, 281, 323/282, 284, 351

[56] References Cited

U.S. PATENT DOCUMENTS

| | | | |
|---|---|---|---|
| 4,928,056 | 5/1990 | Pease | 323/314 |
| 5,063,304 | 11/1991 | Iyengar | 307/296.6 |
| 5,066,901 | 11/1991 | Cheah et al. | 323/267 |
| 5,570,004 | 10/1996 | Shibata | 323/303 |
| 5,596,265 | 1/1997 | Wrathall | 323/315 |
| 5,710,740 | 1/1998 | Manning | 365/222 |

*Primary Examiner*—Adolf Denake Berhane
*Attorney, Agent, or Firm*—Fariba Rad

[57] ABSTRACT

There is disclosed a shunt voltage regulator which utilizes a reference voltage which generates a floating output voltage with respect to a voltage to be regulated. The shunt voltage regulator of this invention also utilizes the voltage to be regulated as a power supply to its reference voltage generator, the level shifters and the Op-Amp.

7 Claims, 5 Drawing Sheets

SHUNT VOLTAGE REGULATOR UTILIZING A FLOATING REFERENCE VOLTAGE

BACKGROUND OF THE INVENTION

This invention relates generally to a voltage regulator and more particularly, to a shunt voltage regulator utilizing a reference voltage generator which generates a floating output voltage with respect to the voltage of the power supply.

Referring to FIG. 1, there is shown a prior art shunt voltage regulator 10. In FIG. 1, a power supply $V_1$ generates a voltage such as 15 volts which due to temperature or load variations might have some fluctuations. In order to create a constant voltage, the shunt voltage regulator 10 is needed. In this example, in addition to regulating the voltage (creating a constant voltage), the output voltage $V_{OUT1}$ is also lowered to 5 volts in order to supply a constant 5 volts to a CMOS circuitry.

The shunt voltage regulator 10 comprises a reference voltage generator 14, an Op-Amp 16, a Metal Oxide Silicon Field Effect Transistor (MOSFET) $T_1$ and two resistors $R_2$ and $R_3$. The negative terminal of the reference voltage generator 14 is grounded and the positive terminal of the reference voltage generator 14 is connected to the inverting input (–) of the Op-Amp 16. The output of the Op-Amp 16 is connected to the gate of the of transistor $T_1$. The source of transistor $T_1$ is grounded and the drain of transistor $T_1$ is connected to an output node 12. The non-inverting (+) input of the Op-Amp 16 is connected to node 12 through resistor $R_2$ and also grounded through resistor $R_3$. In addition, the power supply $V_1$ is connected to the output node 12 through resistor $R_1$.

In FIG. 1, the output voltage $V_{OUT1}$ at node 12 is equal to:

$$V_{OUT1}=(R_2+R_3)I_1=[(R_2+R_3).V_3/R_3]=(1+R_2/R_3)V_3.$$

Also, since Op-Amp 16 is used in linear mode, the voltage of the non-inventing input is set to be equal to the voltage of the inverting input which is equal to the output voltage of the reference voltage generator 14. The reference voltage generator 14 generates a reference voltage $V_R$ of 1 volt. Therefore, both voltages of the inverting and the non inverting inputs of the Op-Amp 16 are equal to 1 volt. Therefore, since $$V_3=V_R,$$

then $$V_{OUT1}=(1+R_2/R_3)V_3=(1+R_2/R_3)V_R.$$

The above relationship indicates that the shunt voltage regulator 10 keeps the output voltage $V_{OUT1}$ independent of input voltage $V_1$ and proportional to the reference voltage $V_R$ from the reference voltage generator 14. The shunt voltage regulator 10 regulates the output voltage $V_{OUT1}$ and compensates for any variation in the voltage of the power supply.

For example, if the power supply $V_1$ fluctuates from 15 volts to 16 volts, the output voltage $V_{OUT1}$ tends to increase. Once the output voltage $V_{OUT1}$ momentarily changes, the voltage of the non-inverting input of the Op-Amp 16 increases. The difference between the two inputs of the Op-Amp 16 increases the gate voltage of the transistor $T_1$ which in turn increases the current drawn from $T_1$ and $R_1$. The increase in the current of $T_1$ and resistor $R_1$ will decrease the voltage of node 12. This continues until the voltage $V_1$ and hence the output voltage $V_{OUT1}$ return back to original values.

By selecting proper $R_2$ and $R_3$, a desired output voltage $V_{OUT1}$ can be selected. For example in FIG. 1, $R_2$ and $R_3$ are selected to set the output voltage at node 12 to 5 volts. In this circuit, since the reference voltage $V_R$ of the reference voltage generator 14 is temperature insensitive, the output voltage $V_{OUT1}$ is also temperature insensitive.

Typically, shunt voltage regulators utilize reference voltage generators to create a fixed voltage at the inverting and the non-inverting inputs of the Op-Amp to generate a fixed voltage at the output node. However, due to the popularity of the CMOS process and in particular P-substrate CMOS process, it is desirable to design a reference voltage generator using bipolar transistors fabricated with P-substrate CMOS technology. Fabricating a bipolar transistor in P-substrate CMOS technology is well known in the industry. Yet, designing a reference voltage generator with bipolar transistors in P-substrate CMOS technology creates a temperature dependent reference voltage with respect to the power supply.

The transient variation of the voltage of the power supply causes the output of the reference voltage generator to vary (float). A typical voltage generator is designed to generate a reference voltage with respect to the ground of the integrated circuit and therefore, the voltage is substantially fixed as the power supply voltage or the temperature varies.

The reason a reference voltage generated by P-substrate CMOS technology has a floating voltage is that the bipolar transistors fabricated by P-substrate CMOS technology are PNP transistors. In order to generate a reference voltage with respect to the ground, NPN transistors are required which can be easily fabricated in N-substrate CMOS technology.

Referring to FIG. 2, there is shown a bipolar transistor 20 fabricated with P-substrate CMOS technology. In P-substrate CMOS technology, the substrate which is a P-substrate is typically connected to ground or the most negative voltage used in the integrated circuit. Therefore, in P-substrate CMOS technology, in order to create a bipolar transistor, the bipolar transistor has to be created in a well. Since the substrate is a p-substrate, the well has to be n-well which then dictates that the bipolar transistor to be a PNP transistor. In this type of configuration, n-well is used as the base B, one of the p+ regions is used as collector C and the other p+ region is used as the emitter E of the bipolar transistor 20.

In FIG. 2, layer 22 is an insulator and layer 24 is a material such as aluminum to be used for the gate G of a P-substrate CMOS transistor. Since the transistor 20 is used as a bipolar transistor, gate G is connected to a voltage above 5 volts which does not affect the function of bipolar transistor 20.

Referring to FIG. 3, there is shown a block diagram of a reference voltage generator 30 built with NPN transistors which generates a fixed 1 volt reference voltage. The reference voltage 1 volt is generated with respect to ground and since the voltage of ground is designated as zero, the output voltage $V_{R1}$ of the reference voltage generator 30 is a fixed 1 volt.

Referring to FIG. 4, there is shown a block diagram of a reference voltage generator 40 built with PNP transistors which generates 1 volt. The reference voltage generator 40 generates a fixed 1 volt reference voltage with respect to power supply $V_2$ and since the voltage of the power supply $V_2$ is typically 5 volts, the output $V_{R2}$ of the reference voltage generator 40 is 5–1=4 Volts. The output of the reference voltage generator 40 is floating since any transient change in the power supply causes the output voltage $V_{R2}$ to vary. For example, if the voltage of the power supply changes to 5.2, then the output $V_{R2}$ is 5.2–1=4.2 Volts.

Therefore, in this specification the term "floating" shall mean "a voltage which is a fixed voltage below the voltage of a power supply and therefore follows the transient changes of the power supply". Furthermore, in this specification "floating reference voltage generator" shall mean a reference voltage generator which generates a floating output voltage such that the difference between the voltage of the power supply and the floating output voltage is a fixed voltage independent of temperature variations.

It is an object of this invention to provide a shunt voltage regulator which utilizes a floating reference voltage generator.

SUMMARY OF THE INVENTION

In accordance with the present invention, a shunt voltage regulator is disclosed which utilizes a reference voltage generator which generates a floating output voltage with respect to a voltage to be regulated. The floating output voltage is a fixed voltage below the voltage to be regulated. Furthermore, the shunt voltage regulator of this invention regulates the voltage to be regulated while utilizing the voltage to be regulated as a power supply to the reference voltage generator and the shunt voltage regulator.

DESCRIPTION OF THE PREFERRED EMBODIMENT

Figure 1:
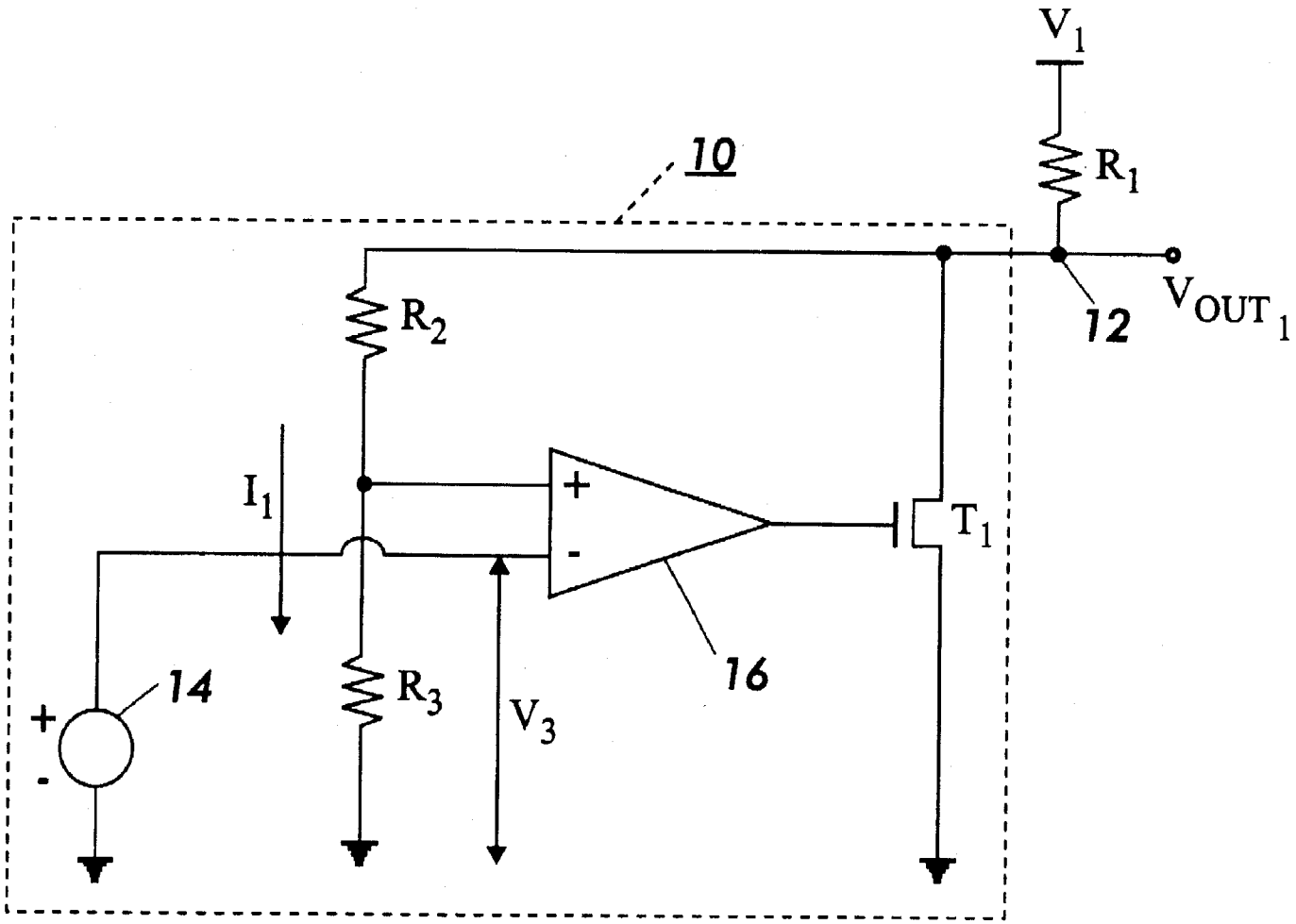
FIG. 1 Prior Art
FIG. 1 shows a prior art shunt voltage regulator.
Figure 2:
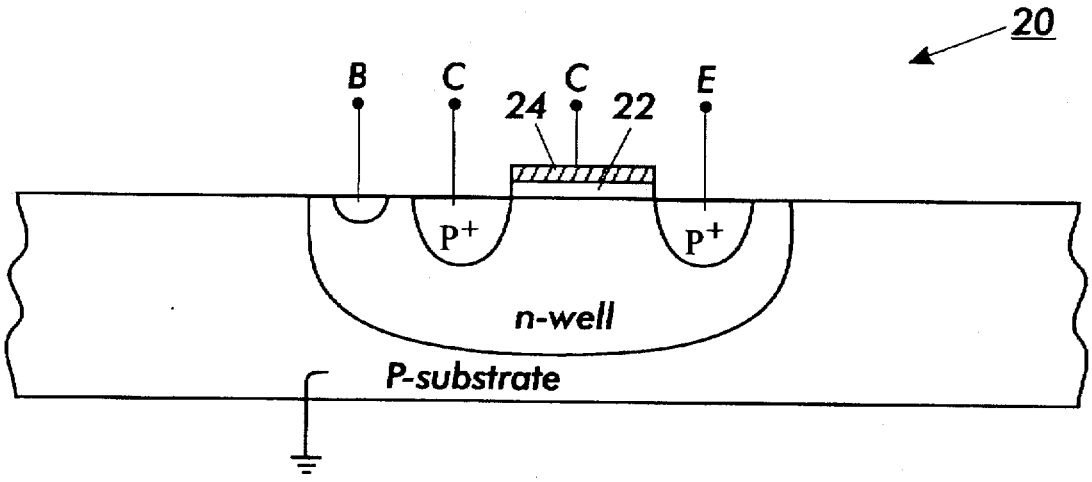
FIG. 2 Prior Art
FIG. 2 shows a bipolar transistor fabricated in P-substrate CMOS technology.
Figure 3:
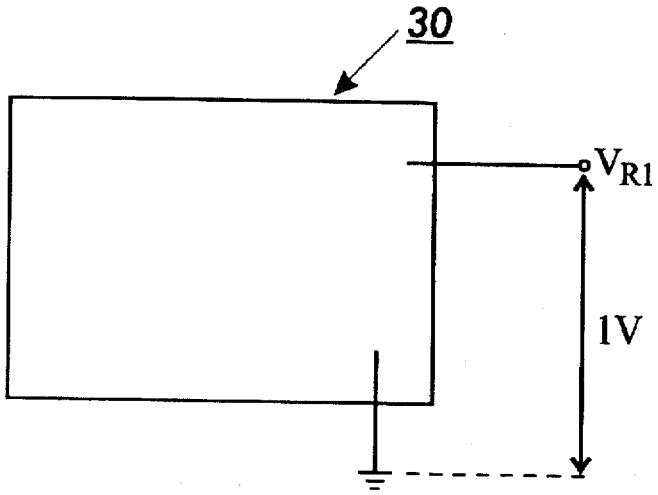
FIG. 3 Prior Art
FIG. 3 shows a block diagram of a reference voltage built with NPN transistors which generates a voltage with respect to ground.
Figure 4:
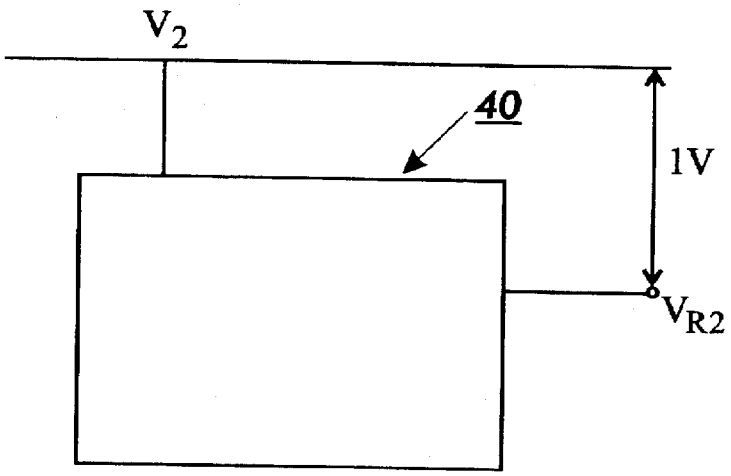
FIG. 4 Prior Art
FIG. 4 shows a block diagram of a reference voltage built with PNP transistors which generates a floating voltage with respect to the power supply.
Figure 5:
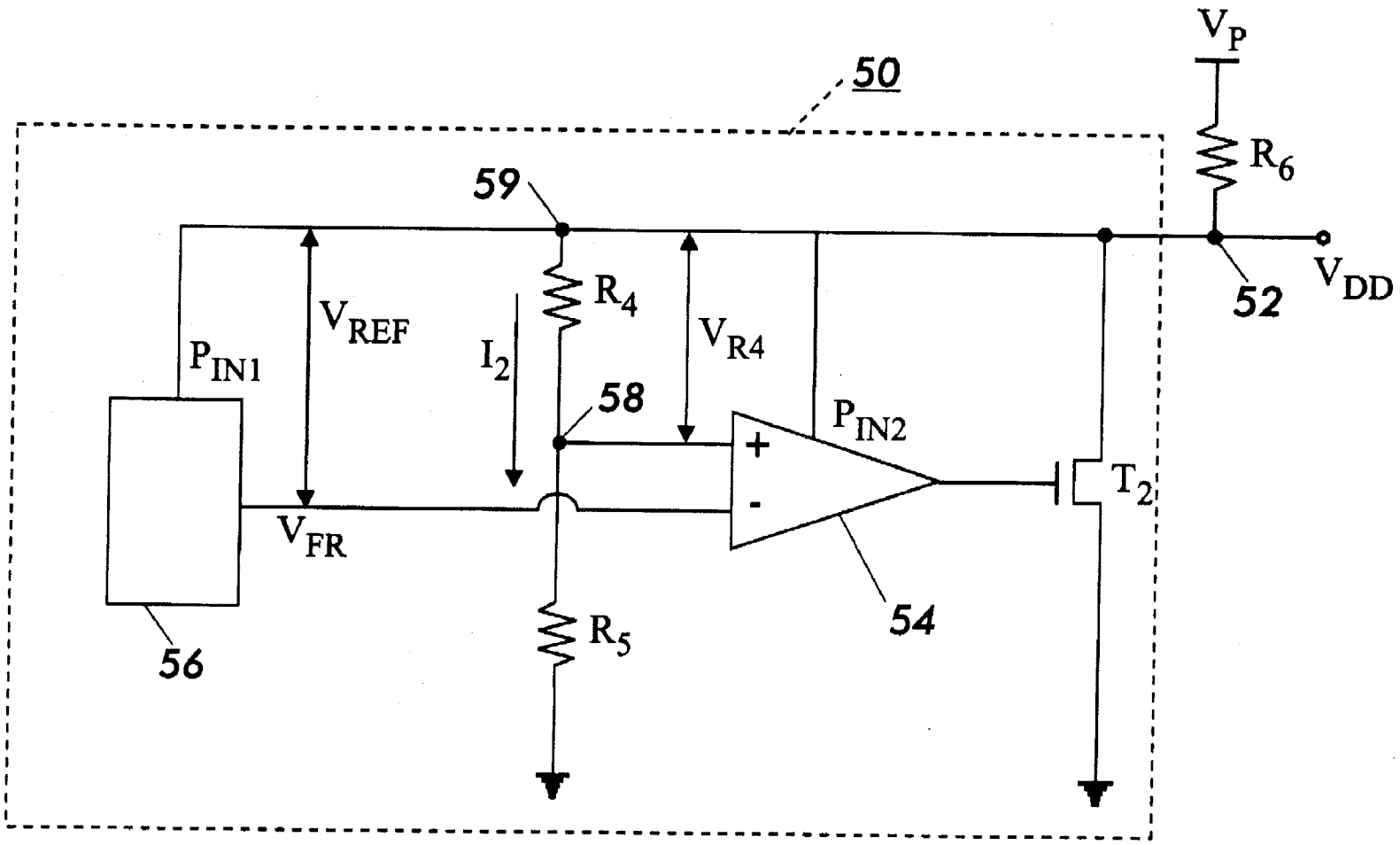
FIG. 5 shows a circuit diagram of the first approach of this invention in designing a shunt voltage regulator which utilizes a floating reference voltage generator.

Referring to FIG. 5, there is shown a circuit diagram 50 of the first approach of this invention to design a shunt voltage regulator which is fabricated in P-substrate CMOS technology and utilizes a floating reference voltage generator.

This invention is designed for the purpose of generating and regulating a voltage $V_{DD}$ such as 5 volts from a power supply $V_P$ which generates a voltage such as 15 volts. The voltage $V_{DD}$ at node 52 will be used as a 5 volts power supply for the entire circuit of the integrated circuit (micro-chip). Since the voltage $V_{DD}$ is used as a power supply for the entire micro-chip, it is also connected to the power input of the reference voltage generator. If the shunt voltage regulator 50 was not present, any fluctuation of the voltage of the power supply $V_P$ would cause the voltage $V_{DD}$ to fluctuate and therefore, the power supplied to the entire micro-chip including the reference voltage generator would also fluctuate. Therefore, the shunt voltage regulator 50 has to regulate the voltage $V_{DD}$ which is also the power to its reference voltage generator.

Hereinafter, since $V_{DD}$ is the voltage that the shunt voltage regulator is regulating, it is referred to as "output voltage $V_{DD}$" and since node 52 is the node which provides the output voltage $V_{DD}$, it is referred to as "output node".

The shunt voltage regulator 50 comprises an Op-Amp 54, a MOSFET $T_2$, two resistors $R_4$ and $R_5$ and a floating reference voltage generator 56. The non inverting input of the Op-Amp 54 is connected to the output node 52 through resistor $R_4$ and also connected to ground through resistor $R_5$. The output of the Op-Amp 54 is connected to the gate of the transistor $T_2$. The drain of the transistor $T_2$ is connected to the output node 52 and its source is grounded. The floating output voltage $V_{FR}$ of the reference voltage generator 56 is connected to the inverting input of the Op-Amp 54. Also, in order to supply power, the output node 52 is connected to the power input $P_{IN1}$ of the reference voltage generator 56 and the power input $P_{IN2}$ of the to the Op-Amp 54.

Typically, the power supply of the reference voltage generator is independent of the voltage needed to be regulated ($V_{DD}$). However, in this invention, due to the nature of the floating reference voltage generator 56, it is necessary to utilize the output voltage $V_{DD}$ of the shunt voltage regulator 50 as the power supply for the reference voltage generator 56 for the following reason.

The voltage of the node 58 is critical in determining the value of the output voltage $V_{DD}$. A fixed voltage applied to node 58 will determine the amount of fixed current $I_2$ which will flow through the resistors $R_4$ and $R_5$. The fixed current $I_2$, will cause a fixed voltage drop across resistors $R_4$ and $R_5$ since node 59 is directly connected to the output node 52, this voltage drop across resistors $R_4$ and $R_5$ determines the output voltage $V_{DD}$ at node 52.

Typically, a fixed reference voltage is used to apply a fixed voltage to node 58. However, since the reference voltage generator 56 is built in P-substrate CMOS technology, it generates a fixed floating reference voltage between its power input $P_{IN1}$ and the floating voltage $V_{FR}$. The Op-Amp 54 operates in linear mode and therefore, its non-inverting input has the same voltage as its inverting input. As a result, the non-inverting input has a voltage equal to $V_{FR}$. Since $V_{FR}$ is a floating voltage, the voltage of node 58 is not a fixed voltage which causes the voltage drop across resistor $R_4$ to fluctuate. The solution to provide a fixed voltage across resistor $R_4$ is to connect node 59 to the power input $P_{IN1}$ of the reference voltage generator 56. Since for the purpose of regulating the output voltage $V_{DD}$, node 52 has to be connected to node 59, the solution is to connect the output voltage $V_{DD}$ as a power supply to the power input $P_{IN1}$ of the reference voltage generator 56.

The floating reference voltage generator 56 generates a fixed voltage $V_{REF}$ between the voltage of its power input $P_{IN1}$ and its floating output voltage $V_{FR}$:

$$V_{REF}=V_{DD}-V_{FR}.$$

$V_{REF}$ is a fixed voltage regardless of the temperature variations and the fluctuations of the power supply and the floating reference voltage. In this circuit, the fixed voltage $V_{REF}$ is transferred across resistor $R_4$. Since the inverting and non-inverting inputs of the Op-Amp 54 have equal voltages, the voltage of the node 58 is equal to $V_{FR}$ and since node 59 is connected to node 52, the voltage at node 59 is equal to the output voltage $V_{DD}$. As a result, the voltage $V_{R4}$ across resistor $R_4$ is the difference between the output voltage $V_{DD}$ and the floating reference voltage $V_{FR}$:

$$V_{R4}=V_{DD}-V_{FR}=V_{REF}.$$

Therefore, the voltage $V_{R4}$ across $R_4$ is a fixed voltage.

The fixed voltage $V_{REF}$ across resistor $R_4$ generates a fixed current $I_2$ which causes a fixed voltage drop across the two resistors R4 and R5 which determines the output voltage $V_{DD}$. If the voltage of the power supply $V_P$ fluctuates, any excess current generated by the fluctuation of the voltage of the power supply $V_P$ will flow through transistor $T_2$. The function of transistor $T_2$ will be described in more detail in the description of FIG. 6.

However, circuit 50 of FIG. 5 is not a proper solution. Typically the output voltage $V_{FR}$ of the floating reference voltage generator 54 is about 4 volts and due to the input common mode range limitation of the Op-Amps, a 4 volts voltage can not be connected to any one of the inputs of Op-Amp 54.

Figure 6:
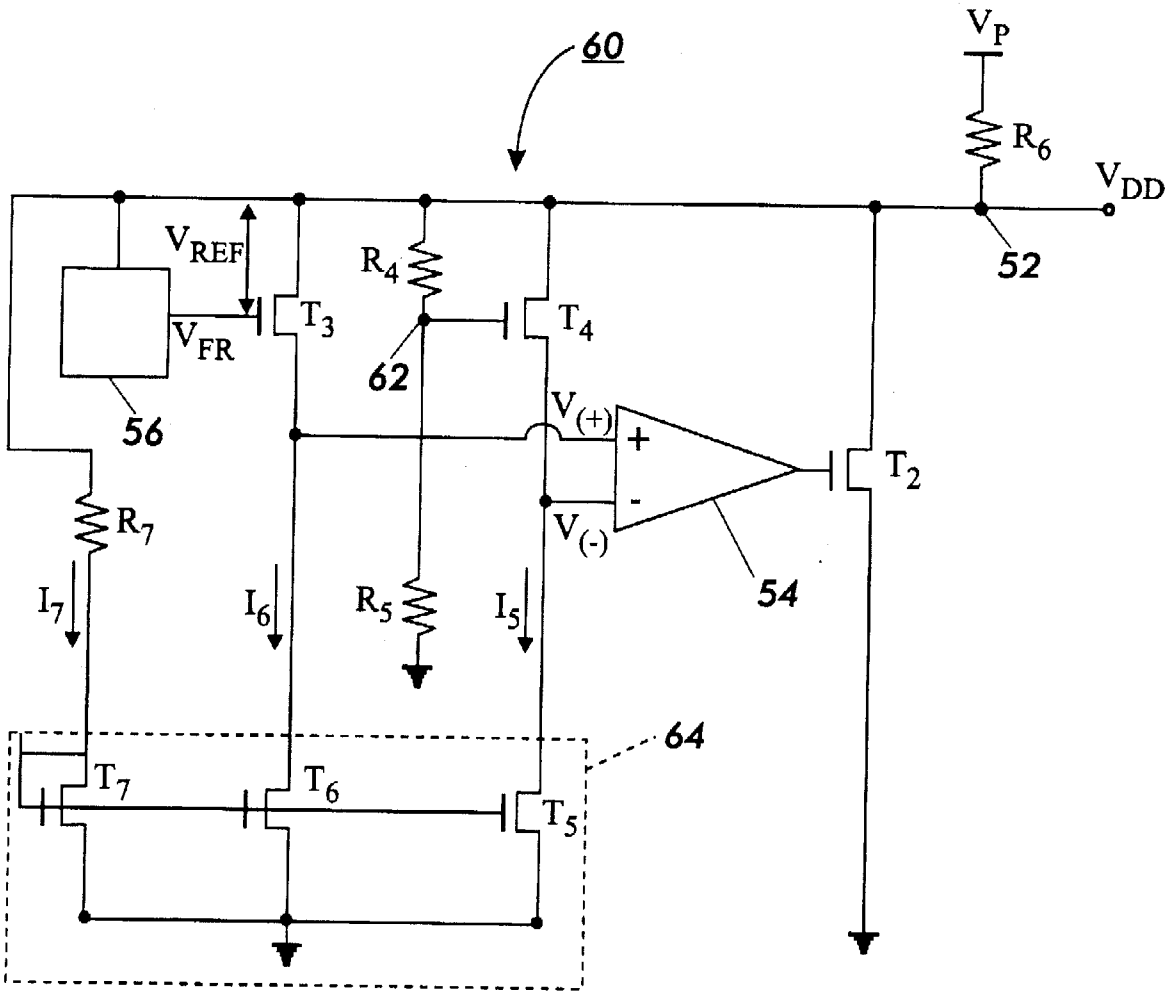
FIG. 6 shows a circuit diagram of the preferred embodiment of the shunt voltage regulator of this invention which utilizes a floating reference voltage generator.

Referring to FIG. 6, there is shown a circuit 60 which is an improved version of circuit 50 of the FIG. 5. In FIG. 6, all the elements that are the same and serve the same purpose as the elements of circuit 50 of FIG. 5 are designated by the same reference numerals.

In FIG. 6, the output voltage $V_{FR}$ from the reference voltage generator 56 is connected to the non-inverting input of the Op-Amp 54 through an n-channel MOSFET (NMOS) $T_3$. Transistor $T_3$ is used as a level shifter to lower the voltage $V_{FR}$ to match the input requirement of the Op-Amp 54. The voltage $V_{FR}$ is connected to the gate of transistor $T_3$, the source of transistor $T_3$ is connected to the non-inverting input of the Op-Amp 54 and the drain of transistor $T_3$ is connected to the output voltage $V_{DD}$.

Transistor $T_3$ shifts down its gate voltage $V_{G3}$ by its gate to source voltage $V_{GS3}$ to its source voltage $V_{S3}$. Therefore, the source voltage $V_{S3}$ or the shifted down voltage is:

$$V_{S3}=V_{FR(shifted\ down)}=V_{G3}-V_{GS3}$$

and since $$V_{G3}=V_{FR},$$

then $$V_{S3}=V_{(-)}=V_{FR(shifted\ down)}=V_{FR}-V_{GS3}.$$

Since the Op-Amp 54 works in the linear mode due to the negative feedback, the inverting and non inverting inputs of the Op-Amp 54 have equal voltages. Thus, the voltage $V_{(+)}$ of the non-inverting input of the Op-Amp 54 is:

$$V_{(+)}=V_{(-)}=V_{FR(shifted\ down)}=V_{FR}-V_{GS3}.$$

In circuit 50 of FIG. 5, node 58 needs to have a voltage equal to $V_{FR}$. For the same reason, the voltage of node 62 has to be equal to $V_{FR}$. Therefore, the voltage of the non-inverting input of the Op-Amp 54 has to be shifted up to its original value of the $V_{FR}$ prior to its connection to node 62. However, the level shifting has to be highly precise to substantially restore the value of the $V_{FR}$.

In order to have a precise level shift up, a NMOS transistor $T_4$ is utilized. The source of transistor $T_4$ is connected to the inverting input of the Op-Amp 54, its gate is connected to node 62 and its drain is connected to the output voltage $V_{DD}$. The voltage of the gate of transistor $T_4$ is:

$$V_{G4}=V_{S4}+V_{GS4}.$$

Since the voltage of the source of the transistor $T_4$ is equal to the voltage of the inverting input of the Op-Amp 54 which is equal to the shifted down $V_{FR(Shifted\ down)}$, then:

$$V_{G4}=V_{FR(Shifted\ down)}+V_{GS4}.$$

Substituting $V_{FR}-V_{GS3}$ for $V_{FR(Shifted\ down)}$, $$V_{G4}=V_{FR}-V_{GS3}+V_{GS4}.$$

In order to have a precise level shift up, $V_{GS3}$ and $V_{GS4}$ have to be substantially equal to cancel each other. To provide equal $V_{GS3}$ and $V_{GS4}$, the two transistors, $T_3$ and $T_4$ are selected to be NMOS to have similar properties and they are placed close to each other on the layout of the integrated circuit to receive similar process. Furthermore, the current flowing through the transistors $T_3$ and $T_4$ have to be identical. Therefore, a current mirror 64 is used to provide identical currents for transistors $T_3$ and $T_4$.

The current mirror 64 has three MOSFET transistors $T_5$, $T_6$ and $T_7$. The gates of transistors $T_5$, $T_6$ and $T_7$ are connected to each other and the sources of transistors $T_5$, $T_6$ and $T_7$ are grounded. The drain of transistor $T_5$ is connected to the source of transistor $T_4$ and the drain of transistor $T_6$ is connected to the source of transistor $T_3$. The drain of transistor $T_7$ is connected to its gate and also to the output voltage $V_{DD}$ through resistor $R_7$. In the current mirror 64, the current $I_5$ of the drain of transistor $T_5$ and the current $I_6$ of the drain of transistor $T_6$ are identical to the current $I_7$ of the drain of the transistor $T_4$. Therefore, the two currents $I_5$ and $I_6$ flowing through the two transistors $T_4$ and $T_3$ are equal.

By designing the two transistors $T_3$ and $T_4$ identical and keeping their currents the same, the gate to source voltages $V_{GS3}$ and $V_{GS4}$ will be substantially the same. As a result, the shifted up voltage $V_{FR}'$ at the gate of transistor $T_4$ will be substantially equal to $V_{FR}$ which in turn keeps the voltage across resistor $R_4$ fixed:

$$V_{DD}-V_{FR}'=V_{DD}-V_{FR}=V_{REF}\ (fixed\ voltage)$$

Therefore, the output voltage $V_{DD}$ will be set to a fixed voltage:

$$V_{DD}=(R_4+R_5)I_2$$

where $$I_2=(V_{DD}-V_{FR}')/R_4=V_{REF}/R_4$$

Therefore, $$V_{DD}=(R_4+R_5)V_{REF}/R_4=(1+R_5/R_4)V_{REF}.$$

In this circuit, since $V_{REF}$ is typically around 1 volt, in order to generate a desired value for $V_{DD}$, the proportion between the two resistors R4 and R5 has to be equal to:

R5/R4=a desired value for $V_{DD}$−1.

For example if $V_{DD}$ needs to be 5 volts, then the ratio of $R_5$ to $R_4$ has to be:

$$5-1=4.$$

So, by selecting $R_5$ to be 4 times larger than $R_4$, a $V_{DD}$ of 5 volts can be generated:

$$V_{DD}=(1+4)V_{REF}=5 \text{ when } V_{REF}=1 \text{ volt.}$$

In addition, transistor $T_2$ is selected to be large enough to accommodate any excess current generated by the fluctuations of the voltage of the power supply $V_P$ or by the fluctuations in the load current (the current drawn by the circuitry connected to $V_{DD}$).

In operation, if the voltage of the power supply $V_P$ increases for example from 15 volts to 16 volts, the voltage of $V_{DD}$ also momentarily increases for example from 5 volts to 5.2 volts. Circuit 60 is designed in such a manner that voltage of node 62 is substantially equal to $V_{FR}$ when $V_{DD}$ is substantially 5 volts. However, once $V_{DD}$ increases, the proportion of $R_4/R_5$ causes the voltage of node 62 to be slightly lower than $V_{FR}$. The difference between $V_{FR}$ and the voltage of node 62 will be transferred to the inputs of Op-Amp 54 which causes the output voltage of the Op-Amp 54 to increase and hence increase the current of transistor $T_2$ and current of resistor $R_6$. More current in resistor $R_6$ causes the voltage of $V_{DD}$ to decrease. This trend continues until the voltage of $V_{DD}$ returns back to its original value (desired value) where the inverting input voltage of Op-Amp 54 becomes equal to the non-inverting input voltage of the Op-Amp 54.

Similarly if the voltage $V_P$ of the power supply decreases or the load current (the current drawn by the circuitry connected to $V_{DD}$) changes, the shunt voltage regulator 60, returns the momentarily changed $V_{DD}$ back to its original value (desired value). Therefore, the shunt voltage regulator of this invention regulates any voltage changes in $V_{DD}$ due to the variations in the voltage of the power supply or the load current. Therefore, the output voltage stays constant regardless of the fluctuations of the voltage of the power supply.

Also, since the output voltage $V_{DD}$ is equal to:

$V_{DD}=(1+R_5/R_4)\ V_{REF}$ and since $V_{REF}$ is temperature independent, thus the output voltage $V_{DD}$ is also temperature independent.

In conclusion, the disclosed embodiment of this invention utilizes a temperature independent floating reference voltage generator to provide a temperature independent and regulated output voltage $V_{DD}$ from an unregulated and temperature sensitive power supply.

It should be noted that circuits 50 and 60 can be built as a stand alone circuit to be used in conjunction with a floating reference voltage generator or each can be built as an integrated circuit in conjunction with a floating reference voltage generator on a common substrate.

It should further be noted that numerous changes in details of construction and the combination and arrangement of elements may be resorted to without departing from the true spirit and scope of the invention as hereinafter claimed.

We claim:

1. A shunt voltage regulator comprising:

a regulating means for regulating a voltage;

a reference voltage generator generating a floating output voltage with respect to said voltage to be regulated;

said voltage to be regulated being electrically connected to said reference voltage generator and to said regulating means as a power supply;

said floating output voltage of said reference voltage generator being a fixed voltage below said voltage to be regulated;

said regulating means being so constructed and arranged to use said floating output voltage as a reference voltage to regulate said voltage to be regulated.

2. A shunt voltage regulator comprising:

a voltage comparing means having a first and a second input and an output;

a reference voltage generator generating a floating output voltage with respect to a voltage to be regulated;

said floating output voltage of said reference voltage generator being a fixed voltage below said voltage to be regulated;

a first level shifting means;

said floating output voltage of said reference voltage generator being electrically connected to said first input of said voltage comparing means through said first level shifting means;

a current bypassing means;

said output of said voltage comparing means being electrically connected to said current bypassing means for controlling said current bypassing means;

said current bypassing means being electrically connected to said voltage to be regulated;

a voltage determining means;

said voltage determining means being electrically connected to said non-inverting input of said comparing means through said second level shifting means;

said voltage to be regulated being electrically connected to said reference voltage generator, said first level shifting means, said voltage determining means, said second level shifting means and said comparing means as a power supply;

said comparing means being constructed and arranged to control said current bypassing means to regulate said voltage to be regulated.

3. The shunt voltage regulator as recited in claim 2, wherein said comparing means is in Op-Amp, said first input of said comparing means is the non-inverting input of said Op-Amp and said second input of said comparing means is the inverting input of said Op-Amp.

4. The shunt voltage regulator as recited in claim 3, wherein said first level shifting means shifts down a voltage and said second level shifting means shifts up a voltage.

5. The shunt voltage regulator as recited in claim 4, wherein said first level shifting means and said second level shifting means are two NMOS transistors.

6. The shunt voltage regulator as recited in claim 3, wherein said current bypassing means is a MOSFET.

7. The shunt voltage regulator as recited in claim 5, wherein said current bypassing means is a MOSFET.

* * * * *